US005882235A

United States Patent [19]

Nakamura

[11] Patent Number: 5,882,235

[45] Date of Patent: Mar. 16, 1999

[54] POWER TILT CYLINDER DEVICE

[75] Inventor: Tamotsu Nakamura, Saitama, Japan

[73] Assignee: Showa Corporation, Gyoda, Japan

[21] Appl. No.: 820,977

[22] Filed: Mar. 19, 1997

[30] Foreign Application Priority Data

Mar. 22, 1996 [JP] Japan ..... 8-091753

[51] Int. Cl.[6] ..... B63H 21/26

[52] U.S. Cl. ..... 440/61

[58] Field of Search ..... 440/53, 61, 900; 91/401

[56] References Cited

U.S. PATENT DOCUMENTS 4,308,018 12/1981 Nakamura et al. ..... 440/61

FOREIGN PATENT DOCUMENTS 60-1097 7/1985 Japan .

554479 12/1993 Japan .

664588 3/1994 Japan ..... 440/61

*Primary Examiner*—Ed L. Swinehart

*Attorney, Agent, or Firm*—Dvorak & Orum

[57] ABSTRACT

In a power tilt device, an opening/closing valve is arranged in a free piston, and an operating member is arranged within a piston rod of a piston and piston rod assembly contained within a closed cylinder. The operating member contacts a supply of hydraulic fluid from an opposite piston side space of a free piston to a first chamber above the piston by opening the opening/closing valve when coming into contact with an end wall of the cylinder during an upward tilting phase of the boat motor. Upon contact, the piston rod is extended outside of the cylinder causing a discharge of hydraulic fluid from the first chamber to an external reservoir, during which time the piston side space and the opposite side space of the free piston are fluidly interconnected.

2 Claims, 4 Drawing Sheets

POWER TILT CYLINDER DEVICE

BACKGROUND OF THE INVENTION

1. Field of the Invention

The present invention relates to a power tilt cylinder device of a vessel propelling device or boat motor.

2. Discussion of the Background Art

Conventionally, as a power tilt cylinder device used for a vessel propelling device of an inboard or an outboard motor, etc., there has been available a cylinder device, which is provided between a vessel body and a propelling unit and in which the propelling unit is supported so as to be tilted against the vessel body by supplying a hydraulic fluid to or discharging a hydraulic fluid from the cylinder device. This cylinder device is composed of a cylinder, a piston rod inserted into this cylinder and extended to the outside of the cylinder via a rod guide, a piston fixed on a piston rod end part inside the cylinder for plotting and forming a first chamber of a piston rod housing side and a second chamber of a piston rod non-housing side in the cylinder and a free piston for plotting the second chamber into a piston side space and an opposite piston side space.

In the power tilt cylinder device, an upper limit position is decided by the contact of the piston with the rod guide during upward tilting, which is carried out for supplying a hydraulic fluid discharged from of a pump to the second chamber. During this period, it is necessary to control an increase in the inner pressure of the cylinder in order to protect the cylinder.

In the conventional technology for controlling an increase in the inner pressure of the cylinder during a upward tilting operation, there is available a technology, whereby in the case of a hydraulic circuit with no free pistons provided in the second chamber of the cylinder, an opening/closing valve for connecting the first and second chambers to each other and an operating member for opening this opening/closing valve are arranged in the piston, the operating member is pressed and moved by being brought into contact with the rod guide during upward tilting and operates to open the opening/closing valve of the piston, and thus the first and second chambers are caused to be communicated with each other. According to this technology, when the operating member is brought into contact with the rod guide provided in the piston in the upper limit position of upward tilting, the opening/closing valve is opened and thereby the first and second chambers are caused to be communicated with each other. As a result, the fluid, which has been supplied to the second chamber, flows away to the first chamber, and this is then discharged from the first chamber and an increase in the inner pressure of the cylinder can be controlled. However, in this conventional technology, if a free piston is provided in the second chamber of the cylinder, even when the opening/closing valve of the piston is opened, and flow of a fluid supplied to the opposite piston side space of the free piston in the second chamber is interrupted by the free piston, and this makes it impossible for a fluid to flow away to the first chamber side as that described above. For this reason, a free piston cannot be provided.

Furthermore, in the foregoing conventional technology, a shock valve is provided in the piston. When the pressure of the first chamber of the cylinder suddenly increases, which occurs, as for instance during rapid movement of a propelling unit period caused by a collision between the running propelling unit and an underwater obstacle, this shock valve serves to cause this hydraulic fluid to escape from the first chamber to the second chamber. However, a return valve for returning the hydraulic fluid from the second chamber to the first chamber after such a collision cannot be provided in the piston. This is because if such a return valve is provided in the piston, which does not have any free pistons, a hydraulic fluid supplied to the second chamber for upward tilting flows away through the return valve to the first chamber and this makes it impossible to perform upward tilting. That is, this conventional technology is disadvantaged by the fact that since a return valve cannot be provided in the piston, the propelling unit cannot return to its original position immediately after the upward movement caused by its collision with an obstacle.

Efforts were made to eliminate this disadvantage. For example, there was disclosed a device in Japanese Unexamined Patent Publication (JP-A) No. 60-1097, in which a free piston is provided in the second chamber of the cylinder and the piston is equipped with both shock and return valves. According to this device, since the piston has the return valve, the propelling unit can return to its original position immediately after the upward movement caused by its collision with an obstacle.

However, in a power tilt cylinder device like that disclosed in Japanese Unexamined Patent Publication (JP-A) No. 60-1097, as described above, it is impossible to control an increase in the inner pressure of the cylinder by providing in the piston an opening/closing valve, which is opened in the upper limit position of upward tilting for causing the first and second chambers to be communicated with each other, and causing a hydraulic fluid to escape from the second to the first chamber.

Therefore, in the conventional technology described in this Japanese Unexamined Patent Publication (JP-A) No. 60-1097, in a duct line for interconnecting a pump and the second chamber, a relief valve for escaping the inner pressure increase of the second chamber during upward tilting to a reservoir is provided. It is necessary to set the opening pressure of this relief valve to a pressure higher than that of the second chamber in order that the valve may not be opened by the pressure of the second chamber during upward tilting (pump discharging pressure) and the normal running position of the propelling unit may be stably maintained. Therefore, each time upward tilting reaches its upper limit position, the relief valve is opened after the discharging pressure of the pump increases to exceed the high opening pressure of the relief valve. As a result, improvements are required in terms of power consumption and pump durability.

SUMMARY OF THE INVENTION

An object of the present invention to provide a free piston and to quickly control an increase in the inner pressure of a cylinder in the upper limit position of upward tilting in a power tilt cylinder device.

In accordance with an aspect of the invention, a power tilt cylinder device is provided between a vessel body and a propelling unit, and the propelling unit is supported so as to be tilted against the vessel body by supplying a hydraulic fluid to or discharging hydraulic fluid from the cylinder device. The cylinder device has a cylinder, and a piston rod inserted into the cylinder and extended to the outside of the cylinder via a rod guide, a piston fixed in a piston rod end part in the cylinder for plotting and forming a first chamber of a piston rod housing side and a second chamber of a piston rod non-housing side and a free piston for plotting the second chamber into a piston side space and an opposite piston side space. The piston is provided with a shock valve, which is opened when the first chamber is suddenly compressed, and a return valve for returning a fluid in the piston side space to the first chamber by the dead weight of the propelling unit. The power tilt cylinder device has an opening/closing valve for interconnecting the piston side space and the opposite piston side space arranged in the free piston and an operating member for opening this opening/closing valve arranged in the piston rod. The operating member supplies a hydraulic fluid from the opposite piston side space of the free piston to the cylinder device and operates to open the opening/closing valve of the free piston by coming into contact with the rod guide during upward tilting, which is carried out for discharging the hydraulic fluid from the first chamber and pushing out the piston rod to the outside of the cylinder, and thereby the piston side space and the opposite side space of the free piston are interconnected.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to limit the present invention.

In the drawings.

DESCRIPTION OF THE PREFERRED EMBODIMENTS

Figure 4:
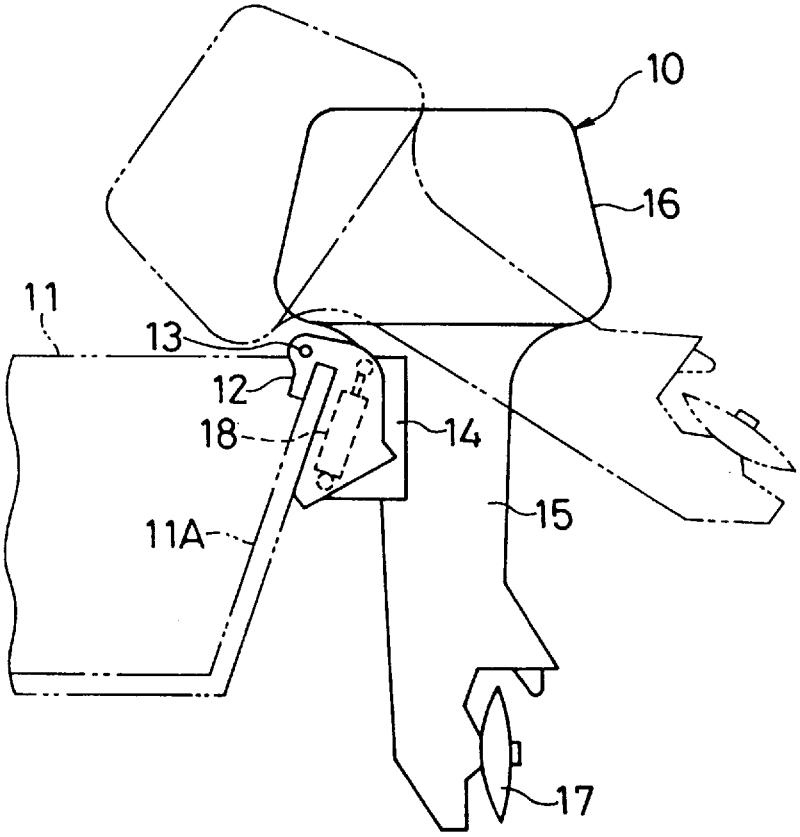
FIG. 4 is a typical view showing a vessel propelling device.

As shown in FIG. 4, a clamp bracket 12 is fixed in the stern plate 11A of a vessel or boat body 11, and a swivel bracket 14 is pivotally attached to the clamp bracket 12 via a tilt shaft 13 so as to be tilted approximately around a horizontal axis, that is, to be tilted up and down. A propelling unit 15 is pivotally attached to the swivel bracket 14 via a steering shaft, not shown, so as to be rotated around the steering shaft. An engine unit 16 is placed on the upper part of the propelling unit 15, and a propeller 17 is provided in the lower part of the propelling unit 15. An outboard motor 10 causes the propelling unit 15 to be tilted by a tilt cylinder device 100, described below.

The base end part of the cylinder 18 of the tilt cylinder device 100 is connected to the clamp bracket 12 by a pin, and the tip part of a piston rod 19, which is inserted into the cylinder 18 and extended to the outside of the cylinder 18 via a rod guide 18A, is connected to the swivel bracket 14 by a pin. The inside of the cylinder 18 is plotted into the first chamber 21 of a piston rod 19 housing side and the second chamber 22 of a piston rod 19 non-housing side by a piston 20, which is fixed on the end part of the piston rod 19.

A shock valve 23 and a return valve 24 are arranged side by side in the piston 20. The shock valve 23 is closed by a spring 23A, and opened when a pressure inside the first chamber 21 abnormally increases, which occurs under the influence of an impact force given by collision with an underwater obstacle, and the increased pressure exceeds a specified pressure value. This makes it possible to transfer hydraulic fluid in the first chamber 21 to the second chamber 22 (piston side space 22A). The return valve 24 is opened when a pressure inside the second chamber 22 (piston side space 22A) exceeds a specified pressure value under the influence of the dead weight of the upwardly tilted propelling unit 15 after the impact force given by the collision with the underwater obstacle has been absorbed.

A free piston 25 is arranged close to the piston 20 in the second chamber 22. The free piston 25 slits the second chamber 22 into a piston side space 22A and an opposite piston side space 22B. The free piston 25 remains in a fixed position before and after the absorption of the impact, which arises due to the collision with the underwater obstacle. Therefore, the amount of hydraulic fluid transferred from the first chamber 21 to the second chamber 22 (piston side space 22A) through the shock valve 23 and the amount of the hydraulic fluid returned from the second chamber 22 (piston side space 22A) to the first chamber 21 through the return valve 24 can be made the same, and the returning position of the piston rod 19 with respect to the cylinder 18 after the impact absorption can be matched with the remaining position of the same before the impact absorption.

In the tilt cylinder device 100, the piston 20 is fitted to the cylinder inner end small diameter part of the piston rod 19 via a stopper ring 26, and the piston 20 is fixed via a spacer ring 28 to the piston rod 19 by a piston nut 27, which is engaged with the cylinder inner end small diameter part of the piston rod 19. The piston 20 has an O ring 29A in its sliding part, which comes into contact with the cylinder 18, and an O ring 29B in its engaging part with the piston rod 19. The free piston 25 has an O ring 29C in its sliding part, which comes into contact with the cylinder 18.

Next, the operation circuit of the foregoing tilt cylinder device 100 will be described. Element 31 represents a reservoir, which can store hydraulic fluid. Element 32 represents a reversible type DC motor and 33 a reversible type gear pump. The pump 33 can be selectively rotated forward or backward by the motor 32. Element 34 represents an opening/closing device, which has a shuttle piston 35, a first check valve 36 and a second check valve 37. A first shuttle space 38 is formed in the first check valve 36 side of the shuttle piston 35, and a second shuttle space 39 is formed in the second check valve 37 side of the same. That is, the first check valve 36 is opened by fluid pressure which is supplied via a duct line 42 during the forward rotation of the pump 33, and the second check valve 37 is opened by fluid pressure supplied via a duct line 43 during the backward rotation of the pump 33. The shuttle piston 35 operates so as to open the second check valve 37 by means of fluid pressure, which arises because of the forward rotation of the pump 33 and the first check valve 36 by means of fluid pressure, which arises because of the backward rotation of the pump 33.

The first check valve 36 of the opening/closing device 34 and the second chamber 22 of the cylinder 18 communicate with each other by a duct line 44. Also, the second check valve 37 of the opening/closing device 34 and the first chamber 21 of the cylinder 18 communicate with each other by a duct line 45.

A check valve 48 is provided in the middle part of a duct line 42A, which is linked to the duct line 42. More particularly, when the piston rod 19 of the cylinder 18 reaches a maximum shrinking position and no fluid is returned from the second chamber 22 of the cylinder 18 to the pump 33 during the downwardly tilting operation of the outboard motor 10, if the pump 33 is to operate, the check valve 48 is opened, and hydraulic fluid can be supplied from the reservoir 31 to the pump 33.

A check valve 49 is provided in the middle part of a duct line 43A, which is linked to the duct line 43. More particularly, the inner capacity of the cylinder 18 increases by an amount equivalent to the leaving capacity of the piston rod 19 from the cylinder 18 during the upwardly tilting operation of the outboard motor 10, and this results in a shortage of the circulation amount of hydraulic fluid. Thus, the check valve 49 is opened and fluid can be supplied from the reservoir 31 to the pump 33 to compensate for the shortage of the circulation amount.

A down relief valve 50 is connected to the middle part of the duct line 43 via a duct line 43B. More particularly, the capacity of the cylinder 18 decreases by an amount equivalent to the entering capacity of the piston rod 19 into the cylinder 18 during the downwardly tilting operation of the outboard motor 10, and this results in a surplus of the circulation amount of hydraulic fluid. Thus, the down relief valve 50 is opened and fluid having been discharged from the pump 33 can be returned to the reservoir 31.

A relief valve 51 for the second chamber is connected to the middle part of the duct line 44. More particularly, when the propelling unit 15 collides with an underwater obstacle and a pressure in the second chamber 22 of the cylinder 18 abnormally increases during backward sailing, in which the propelling unit 15 is held in an optional upper position, the relief valve 51 for the second chamber is opened and thereby pressure increased hydraulic fluid can be returned to the reservoir 31.

A manual valve 52 is provided via a bypass duct line 46 between the duct line 45, which is communicated with the first chamber 21 of the cylinder 18, and the duct line 44, which is communicated with the second chamber 22. More particularly, the first and second chambers 21 and 22 of the cylinder 18 can be communicated with each other by opening the manual valve 52 and the piston rod 19 is manually extended or contracted. Thereby, the propelling unit 15 can be freely swung between its lower position and its maximum tilted-up position.

In order to protect the cylinder 18 by causing hydraulic fluid to escape from the second chamber 22 in the upward tilting limit position of the outboard motor 10, the tilt cylinder device 100 has a structure described below.

An opening/closing valve 60 for interconnecting the piston side space 22A and the opposite piston side space 22B is arranged in the free piston 25, and an operating member 70 for opening this opening/closing valve 60 is arranged in the cylinder inner end part of the piston rod 19.

The opening/closing valve 60 is composed of a valve case 62, which is fitted in an opening part 61 formed by penetrating the center part of the free piston 25 so as to sandwich an O ring 29D, a poppet valve 63, which comes into contact with or moves away from a valve seat provided in the valve body 62, a spring 64, which presses the poppet valve 63 to the valve seat of the valve body 62, a valve cap 65, which is fitted over the valve body 62, a filter 67, which is held by the valve cap 65 and positioned in the entrance part 66 of the valve body 62, and a washer 68, which is backed up by the outer ring of the filter 67 and supports the spring 64.

The operating member 70 is composed of a push pin 72, which is inserted into a long hole portion 71 formed diametrically centered within the large diameter portion of the piston rod 19 and can be displaced in the axial direction of the piston rod within the range of the long hole of the long hole portion 71. The operating member also includes a push rod 74, which is inserted into a formed shaft hole part 73 from the cylinder inner end surface of the piston rod 19 and connected to the push pin 72 by a pin, a spring receiver 75, which is engaged with the middle step part of the push rod 74, a spring 76, which is received by the spring receiver 75 and presses the push rod 74 and the push pin 72 to the rod guide 18A side of the cylinder 18, and a center piece 77, which is backed up by a piston nut 25 27 and supports the spring 76. The push rod 74 penetrates the center piece 77 and is placed opposite the poppet valve 63 of the opening/closing valve 60. The piston nut 27 has an O ring 29E between itself and the center piece 77, and the center piece 77 has an O ring 29F between itself and the push rod 74.

Figure 3A:
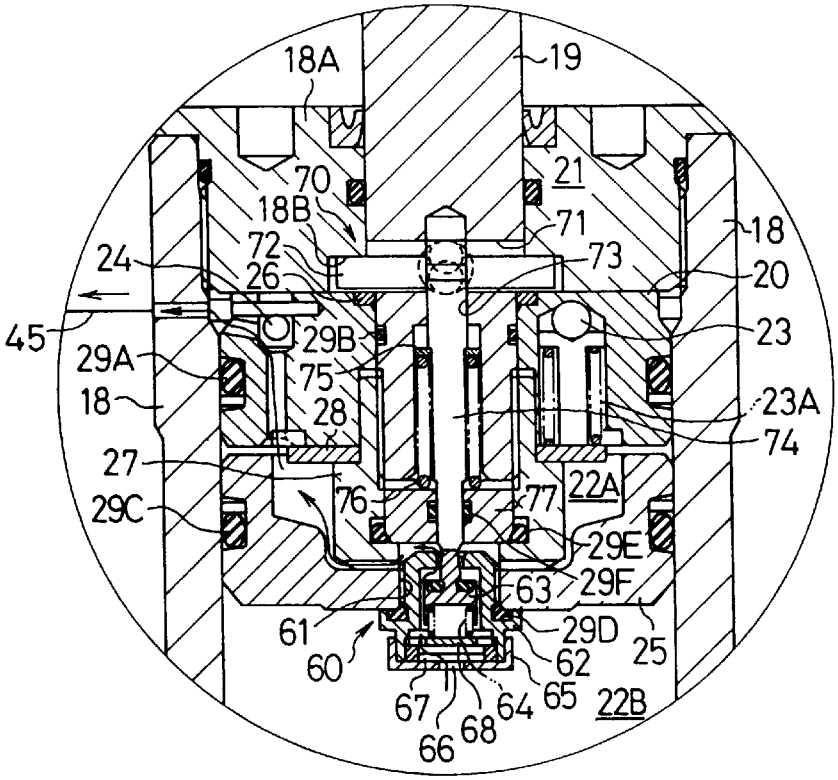
FIGS. 3A and 3B are typical views showing an operating condition of the power tilt cylinder device.

Therefore, as shown in FIG. 3A, in the upper limit position of upward tilting, where the piston rod 19 is pushed out outside of the cylinder 18 by hydraulic fluid from the opposite piston side space 22B of the free piston 25 to the tilt cylinder device 100 and discharging the same from the first chamber 21, the push pin 72 is housed in a recessed storing part 18B formed in the rod guide 18A, and comes into contact with the operating member 70. The push pin 72 and the push rod 74 are pushed downward against the spring 76 and the poppet valve 63 of the opening/closing valve 60 provided in the free piston 25 is pushed open. Thereby, the piston side space 22A of the free piston 25 and the opposite piston side space 22B are interconnected, and the hydraulic fluid, which has been supplied to the opposite piston side space of the second chamber 22, escapes to the first chamber 21 through the opening/closing valve 60 of the free piston 25, the piston side space 22A and the return valve 24 of the piston 20 and then discharges to the outside of the cylinder 18.

Figure 3B:
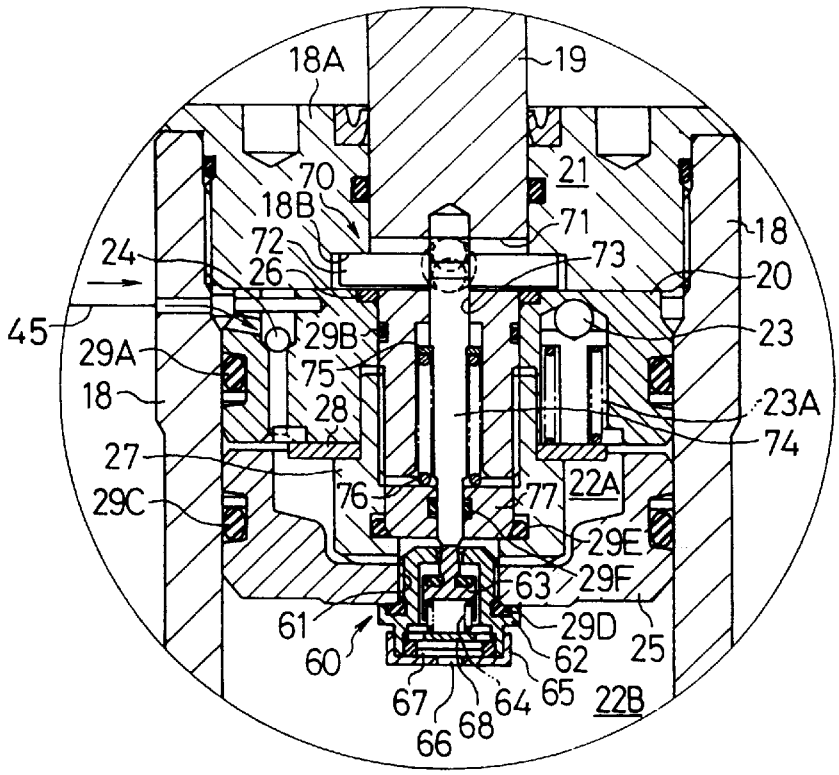

When the tilt cylinder device 100 performs downward tilting function from the upper limit position of upward tilting, as shown in FIG. 3B, hydraulic fluid supplied to the first chamber 21 closes the return valve 24 of the piston 20 and presses down the piston 20.

In the tilt cylinder device 100, the first chamber 21 of the cylinder 18 is sealed by screw fitting, etc., of the shock valve 23, the return valve 24 of the piston 20, the O rings 29A, 29B, 29E and 29F and the piston nut 27. The opposite piston side space 22B of the cylinder 18 is sealed by the opening/closing valve 60 of the free piston 25 and the O rings 29C and 29D.

Next, the operation of the tilt cylinder device 100 will be described.

(Upward tilting operation)

The upward tilt operation of the outboard motor 10 is as follows.

Figure 1:
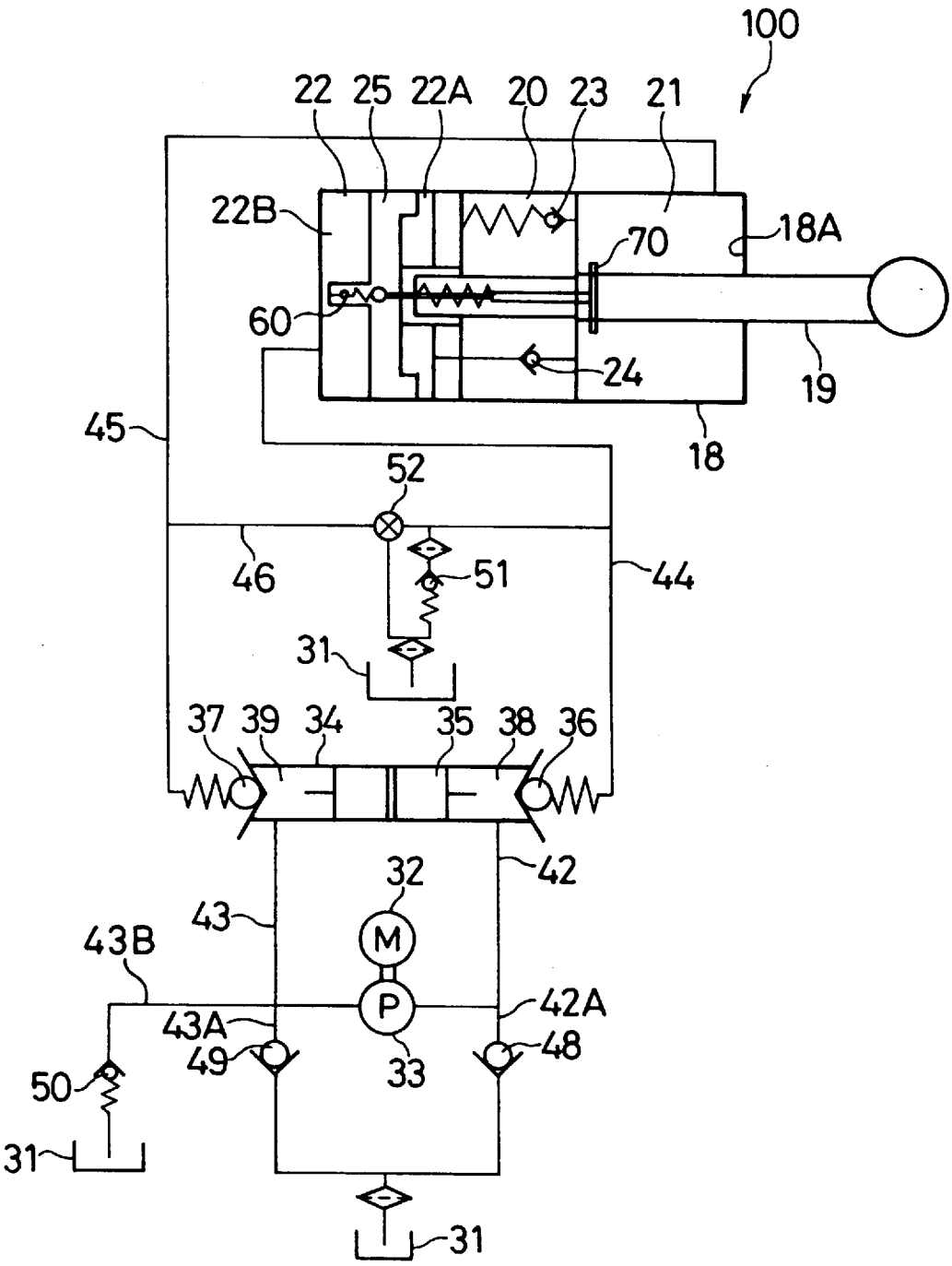
FIG. 1 is a circuit diagram showing a power tilt cylinder device.
Figure 2:
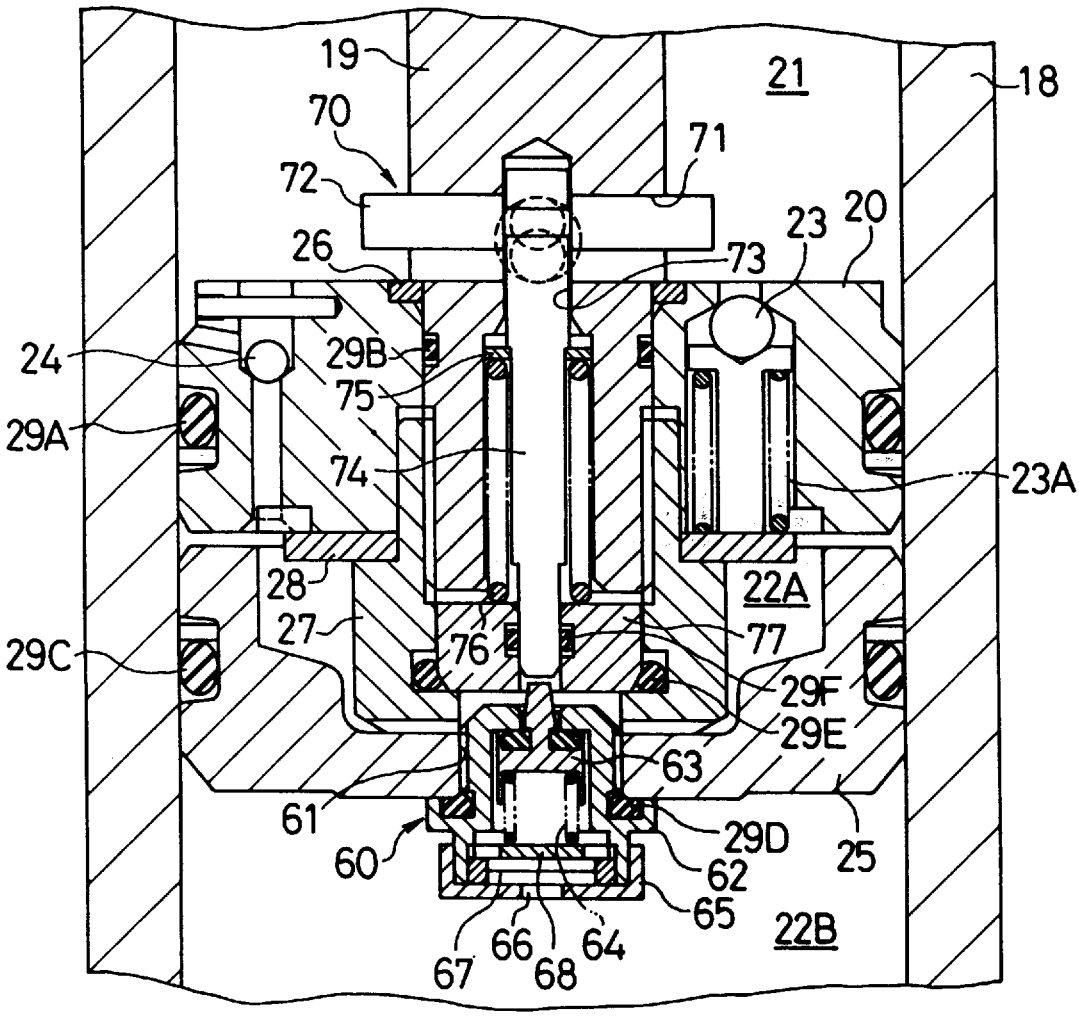
FIG. 2 is a typical view showing main portions of the power tilt cylinder device.

When the motor 32 is actuated for upward tilting and the pump 33 is rotated forward, fluid discharged from the pump 33 enters the opposite piston side space 22B of the second chamber 22 of the cylinder 18 after passing through the duct line 42, the first check valve 36 and the duct line 44, pushes up the piston rod 19 and enables the propelling unit 15 to be tilted from a lower position indicated by a solid line shown in FIG. 1 to an upper position indicated by a 2-dotted chain line. Fluid in the first chamber 21 of the cylinder 18 is returned to the pump 33 through the duct line 45, the second check valve 37 and the duct line 43.

During this upward tilting period, in the upper limit position of upward tilting, in which the piston rod 19 reaches its maximum extended position, the push pin 72 of the operating member 70 comes into contact with the rod guide 18A, and thereby the operating member 70 operates, as described above, to open the opening/closing valve 60 of the free piston 25 and interconnect the piston side space 22A of the free piston 25 and the opposite piston side space 22B. Consequently, hydraulic fluid, which has been supplied to the opposite piston side space 22B of the second chamber 22, flows away to the first chamber 21 through the opening/closing valve 60, the piston side space 22A of the second chamber 22 and the return valve 24 of the piston 20 and is then discharged from the first chamber 21 to the reservoir outside of the cylinder 18. In this manner, the inner pressure increase of the cylinder 18 is controlled.

During this period, the opening/closing valve 60 is always brought into contact with the rod guide 18A in the upper limit position of upward tilting and is immediately opened. Thus, the inner pressure increase of the cylinder 18 is quickly controlled, and this makes it possible to reduce power consumption and improve pump durability.

(Downward tilting operation)

The downward tilting operation of the outboard motor 10 is as follows.

When the motor 32 is actuated for downward tilting and the pump 33 is rotated backward, fluid discharged from the pump 33 enters the first chamber 21 of the cylinder 18 after passing through the duct line 43, the second check valve 37 and the duct line 45, and presses down the piston rod 19. Fluid in the second chamber 22 of the cylinder 18 is returned to the pump 33 through the duct line 44, the first check valve 36 and the duct line 42.

(Rapid upward movement or jumping-up operation)

The jumping-up operation of the outboard motor 10 following its collision with an underwater obstacle is as follows.

When an underwater obstacle comes into collision with the propelling unit 15, a large tensile strength is applied on the piston rod 19, the pressure of the first chamber 21 of the cylinder 18 is increased, the shock valve 23 is opened, hydraulic fluid in the first chamber 21 is transferred to the piston side space 22A of the second chamber 22, the piston rod 19 is extended, which causes the propelling unit 15 to jump up, and an impact force is absorbed. After the absorption of the impact force, a pressure in the piston side space 22A is increased by the dead weight of the propelling unit 15, the return valve 24 is then opened, the hydraulic fluid in the piston side space 22A is returned to the first chamber 21, and the propelling unit 15 is returned to its position before its jumping up by contracting the piston rod 19. Furthermore, as described above, in this embodiment, the free piston 25 is provided in the second chamber 22. Thus, the amount of hydraulic fluid transferred from the first chamber 21 to the second chamber 22 and the amount of the hydraulic fluid returned from the second chamber 22 to the first chamber 21 are the same before and after the impact absorption. Thereby, the returning position of the piston rod 19 after the impact absorption can be matched with its lower position before the impact absorption.

Apparent from the foregoing description, in the present invention, the power tilt cylinder device is provided with a free piston and it is possible to quickly control the inner pressure increase of the cylinder in the upper limit position of upward tilting.

While there has been described a preferred embodiment of the invention with reference to the accompanying drawings, it is to be understood that a specific constitution of the invention is not limited to this embodiment and various modifications are possible without departing from the spirit and scope of the invention, and it is intended to cover in the appended claim all such modifications as fall within the invention.

What is claimed is:

1. A power tilt device provided between a vessel body and a vessel propelling unit, the propelling unit being supported so as to be tilted against the vessel body by the device, the device comprising:

closed cylinder having a pair of end walls, a first end wall including a central opening therein that defines a rod guide of said cylinder; a piston rod and piston assembly, inserted into the cylinder, said piston rod extending outside the cylinder via the rod guide, said piston fixed to an end of said piston rod and defining a first chamber between said piston and said first cylinder end wall and a second chamber formed between said piston and a second end wall of said cylinder, said first chamber including a hydraulic fluid therein;

a free piston disposed within the second chamber, which said free piston splits said second chamber into a piston side space and an opposite piston side space, said piston provided with a shock valve and a return valve, said shock valve adapted to be opened when the hydraulic fluid of said first chamber is pressurized in order to transfer said fluid into said second chamber, said return valve for returning hydraulic fluid from the piston side space of the second chamber to the first chamber by a dead weight of the propelling unit;

an opening/closing valve for fluidly interconnecting the piston side space of the second chamber with the opposite piston side space, said opening/closing valve arranged in said free piston and including an operating member disposed in said piston rod for controlling said opening/closing valve, said operating member adapted to open the opening/closing valve and transfer said hydraulic fluid from the opposite piston side space to said piston side space, and then to the first chamber upon a contact with the first end wall of said cylinder during an upward tilting phase of said propelling unit, wherein the piston rod moves toward the first end wall and the hydraulic fluid transferred into the first chamber is discharged to a reservoir outside said cylinder.

2. The power tilt device as set forth in claim 1, wherein said opening/closing valve comprises a valve body fitted within an opening formed in the center of the free piston, said valve body including a valve seat formed therein, a poppet valve provided in the valve body, and seating against said valve seat, a spring for biasing the poppet valve against the valve seat of the valve body, said operating member comprising a push pin, a spring and a push rod, said push pin disposed within a radially oriented hole formed in the piston rod, said push pin displaceable in the lengthwise direction of the piston rod, said push rod disposed in a blind shaft hole formed in an end surface of the piston rod, said push rod connected to the push pin by a pin, said spring biasing the push rod and the push pin toward the end first wall of the cylinder, wherein the push rod of the operating member is placed opposite the poppet valve of the opening/closing valve.

* * * * *